US005295453A

United States Patent [19]

Inoue

[11] Patent Number: 5,295,453

[45] Date of Patent: Mar. 22, 1994

[54] CATAMARAN HAVING A SUBMERGED AIRFOIL

[75] Inventor: Junichi Inoue, Yokosuka, Japan

[73] Assignee: Hikari Industry Co., Ltd., Kanagawa, Japan

[21] Appl. No.: 829,787

[22] Filed: Jan. 31, 1992

[30] Foreign Application Priority Data

May 21, 1991 [JP] Japan ..... 3-67983[U]

[51] Int. Cl.[5] ..... B63B 1/24

[52] U.S. Cl. ..... 114/61; 114/274; 210/242.3

[58] Field of Search ..... 114/61, 274; 210/242.1, 210/242.2, 242.3, 242.4

[56] References Cited

U.S. PATENT DOCUMENTS

| | | | |
|---|---|---|---|
| 3,928,206 | 12/1975 | Warren | 210/242.3 |
| 3,931,740 | 1/1976 | Carter | 210/242.3 |
| 4,128,068 | 12/1978 | Ogura et al. | 210/242.3 |
| 4,551,244 | 11/1985 | Inoue | 210/242.1 |
| 5,019,277 | 5/1991 | Andelin | 210/242.3 |

FOREIGN PATENT DOCUMENTS

| | | | |
|---|---|---|---|
| 5540180 | 2/1975 | Japan . | |
| 70588 | 6/1979 | Japan | 210/242.3 |
| 109191 | 4/1989 | Japan | 114/61 |
| 18191 | 1/1990 | Japan | 114/274 |
| 605244 | 9/1978 | Switzerland | 114/274 |

*Primary Examiner*—Michael S. Huppert
*Assistant Examiner*—Thomas J. Brahan
*Attorney, Agent, or Firm*—Skjerven, Morrill, MacPherson, Franklin, & Friel

[57] ABSTRACT

A catamaran includes a pair of floats, a deck extending in the air between the pair of floats as fixedly attached thereto and a connecting member extending in the water between the pair of floats as fixedly attached thereto. The connecting member has an airfoil-shaped section so that a lift is provided to the bow of the catamaran while it is cruising. Preferably, the airfoil-shaped section is inclined to define an attack angle in a range between 15 degrees and 25 degrees and most preferably approximately at 20 degrees. When applied to a working catamaran having a rotating impeller for collecting floats, a tail section is provided as extending downstream from a downstream edge of the air-foiled section.

6 Claims, 3 Drawing Sheets

CATAMARAN HAVING A SUBMERGED AIRFOIL

BACKGROUND OF THE INVENTION

1. Field of the Invention

This invention generally relates to a water vessel and in particular to a catamaran including a submerged connection member connecting a pair of floats or hulls.

2. Description of the Prior Art

A catamaran typically includes a pair of hulls or floats which are joined by a deck or some other connecting structure bridging between them. However, such a connecting structure normally extends in the air and not submerged under the water. In the past, the present inventor invented a working catamaran including a pair of floats joined by a submerged connecting member for use in collecting solid floating materials on the water surface as disclosed in the Japanese Utility Model Post-examination Publication No. 57-18238. The working catamaran disclosed in this publication is illustrated here as FIGS. 4*a* through 4*c*. As shown in these figures, the working catamaran generally indicated by numeral 1 includes a pair of floats or hulls 2. In the illustrated structure, a bow tip end 3 of each of the floats 2 is located toward well 4, which is a region sandwiched between the floats 2 spaced apart from each other, with respect to its longitudinal center line CL. And, each of the floats 2 has a substantially vertical inner side wall at its bow portion a, intermediate portion b and stern portion c. In particular, the inner side walls b of the opposite floats 2 extend substantially in parallel each other and with respect to the longitudinal center axis CL of each of the floats 2.

A connecting member 5 extends between the opposite inner side wall surfaces a of the floats 2 at those portions d that are submerged under water. The connecting member 5 is fixedly attached at each end to the floats 2 so as to provide an increased structural integrity. Because of the provision of this connecting member 5, the floats 2 may be spaced apart at a greater distance than otherwise possible. This is particularly important in such a working vessel since it allows to sweep a wider water surface. As shown in FIG. 4*b*, the connecting member 5 is defined as a waterfoil having a particular cross sectional shape. That is, the connecting member 5 includes a curved bottom surface 5*a* which extends from the bow end downwardly until it hits the bottom of the float 2 with increasing its radius of curvature, and, then, extends along the bottom of the float 2 until it reaches its downstream end 5*c*. The curved portion of the bottom surface 5*a* extends generally from the forward end of the submerged inner side wall surface portion d to the bottom e of the bow portion a, whereby a space 5*d* having a generally triangular-shaped cross section is defined below the bottom surface 5*a*. The connecting member 5 also includes a curved top surface 5*b* which first extends substantially horizontally from the bow end over a predetermined distance and then extends downwardly toward the downstream end 5*c* with its radius of curvature gradually increasing. The particular shape of the connecting member 5 as described above is advantageous in providing stability while the working catamaran is in operation.

As also shown in FIG. 4*b*, a rotating impeller 7 is disposed above the connecting member 5 and extending between the opposite floats 2. And, thus, as the working catamaran 1 cruises, any solid materials floating on the water surface is first trapped in a mouth between the opposite floats 2 and then driven into the downstream portion of the well 4 defined between the opposite floats 2 by means of the rotating impeller 7. Also provided is a deck 6 extending between the floats 2 and in the air, which provides a working area for an operator and a bridge or operating room may be provided on the deck 6.

Thereafter, the present inventor improved the catamaran disclosed in the above publication so as to allow to collect oil spills rather than solid floating materials and filed a Japanese Patent Application, No. 58-29378, and also a U.S. patent application, Ser. No. 582,199, which has been issued as U.S. Pat. No. 4,551,244, which is hereby incorporated by reference. This improved catamaran also includes a connecting member which is similar in many respects to the connecting member 5 illustrated in FIGS. 4*a* through 4*c* and described above.

As described above, the working catamaran provided with a submerged connecting member is advantageous in attaining stability in operation and such a submerged connecting member also has some merits in providing stability while cruising particularly through rough waters. However, it has been found that the bow end tends to become submerged under water when the working catamaran cruises at a relatively high speed. Since there are those cases in which the working catamaran is required to cruise at a relatively high speed so as to reach a site as soon as possible so that a collecting operation can be carried out immediately, it is also important that the working catamaran can cruise at a relatively high speed without problems. However, in the prior art structure, since the bow end tends to become submerged when the cruising speed increases, there has been an upper limit in the cruising speed. According to the experiments conducted by the present inventor, it has been found that a catamaran having a structure described above has a tendency to cause its bow end to be submerged under water when its cruising speed is increased even if the connecting member 5 has been removed. Therefore, there is an upper limit in the cruising speed for such a catamaran irrespective of whether it is provided with a connecting member or not.

SUMMARY OF THE INVENTION

In accordance with the present invention, there is provided a catamaran comprising a pair of floats or hulls spaced apart from each other and a connecting member having, in general, an airfoil cross sectional shape, which extends between the pair of floats and which is submerged when said catamaran is afloat. In a preferred embodiment, the connecting member has a generally convex top surface and a generally convex bottom surface to define the airfoil cross sectional shape. A base line of the airfoil shaped connecting member, which is defined by drawing a straight line between its leading and trailing edges, is set at an angle in a range between 15° and 25° and most preferably approximately at 20° inclined upwardly forwardly with respect to a horizontal surface.

In a preferred embodiment, the connecting member has a two-part structure, i.e., airfoil-shaped part and a tail part which extends continuously from the trailing end portion of the airfoil-shaped part in the downstream direction. The tail part is preferably comprised of a parallel plate which extends in the downstream direction from the downstream end portion of the airfoil-shaped part. The tail part may extend generally horizontally or at an angle, if desired.

It is therefore a primary object of the present invention to provide an improved catamaran which can cruise at a relatively high speed without problem.

Another object of the present invention is to provide an improved working catamaran which is stable both at high speeds and low speeds.

A further object of the present invention is to provide an improved catamaran which can be advantageously used for collecting floating materials, solid or liquid, on the water surface efficiently.

Other objects, advantages and novel features of the present invention will become apparent from the following detailed description of the invention when considered in conjunction with the accompanying drawings.

DESCRIPTION OF THE PREFERRED EMBODIMENTS

Figure 1A:
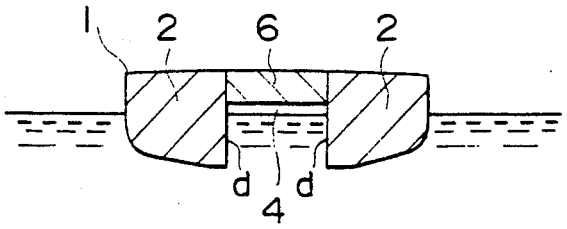
FIG. 1*a* is a schematic illustration showing in transverse cross section a catamaran constructed in accordance with an embodiment of the present invention.
Figure 1B:
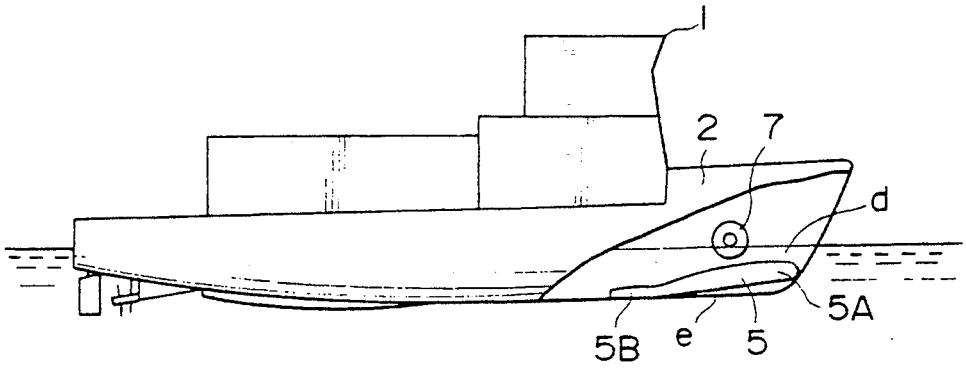
FIG. 1*b* is a schematic illustration showing in side elevation with a part of the catamaran of FIG. 1*a* removed.
Figure 1C:
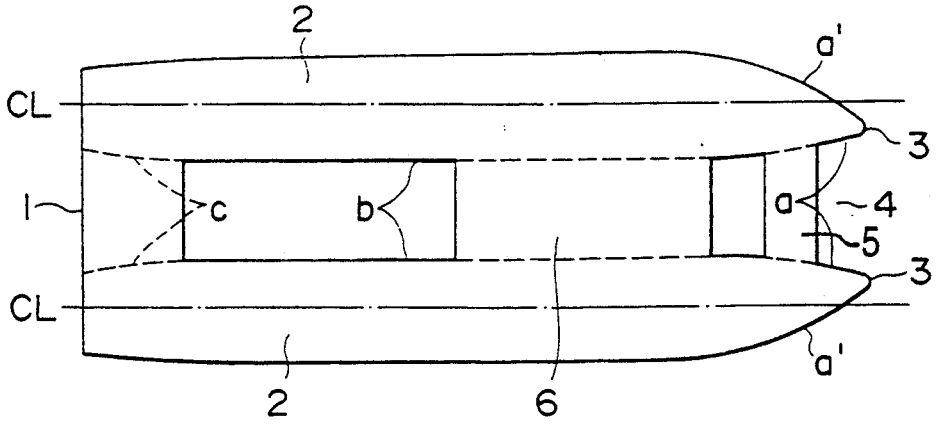
FIG. 1*c* is a schematic illustration showing in plan view the catamaran of FIG. 1*a;*

Referring now to FIGS. 1*a* through 1*c*, a catamaran 1 constructed in accordance with one embodiment of the present invention will be described in detail. As shown, the present catamaran 1 includes a pair of floats or hulls 2 which are elongated in shape and spaced apart from each other over a predetermined distance to thereby define a well 4 therebetween. In the illustrated embodiment, each of the floats 2 has a bow end 3 which is shifted in position toward the well 4 with respect to its center line CL. Each of the floats 2 also has a substantially vertical inner side wall surface at its bow portion a, intermediate portion b, and stern portion c. The side walls of the intermediate portions b are substantially parallel to each other and with respect to the center lines CL of the floats 2. It is to be noted, however, that the present invention should not be limited only to floats having such a specific structure, and the present invention may be applied to floats having various other structures.

The catamaran 1 further includes a connecting member 5 extending between the pair of floats 2 as fixedly attached thereto at its opposite ends. In this embodiment, the connecting member 5 is disposed to extend between submerged portions d of the inner side wall surfaces at the bow portions a as extending from the bow end to a bottom e of the float 2. Thus, the connecting member 5 remains submerged in the water when the catamaran 1 is afloat. As described before, the provision of such a connecting member 5 allows to set a distance between the opposite floats 2 as wide as possible because of an increased structural integrity given by the connecting member 5. As will be described in detail later, the connecting member 5 of the present invention has a generally airfoil-shaped cross section. In the illustrated embodiment, the connecting member 5 has a two-part structure, including a forward airfoil-shaped section 5A and a tail section 5B which is connected to the trailing end of the forward section 5A. As far as the prevention of bow dipping is concerned, the forward section 5A plays a major role since this is the section which provides a lift to the catamaran 1 during operation. The tail section 5B mainly serves to guide the flow of water toward its stern. As will be described in detail later, the forward airfoil-shaped section 5A is preferably inclined forwardly at a predetermined angle, which ranges between 15° and 25°, most preferably at 20°.

The catamaran 1 is also provided with those elements which are ordinarily provided in a water vessel, such as an engine, a transmission, a screw and a rudder, so that the catamaran 1 can cruise by itself at any desired speed and in any desired direction. The catamaran 1 is also provided with a deck 6 extending in the air between the pair of floats 2. The deck 6 provides a space for mounting thereon a bridge or operating room. In the present embodiment, since the catamaran 1 is mainly designed to serve as a working catamaran for collecting floating materials on the water surface, a rotating impeller 7 is also provided above the airfoil-shaped connecting member 5 extending between the pair of opposite floats 2. The rotating impeller 7 is disposed such that it is partly submerged in the water at its bottom portion. Thus, when the catamaran 1 cruises with its impeller 7 in rotation in a predetermined direction, any floating material on the water surface which has been trapped in a mouth defined between the pair of opposite floats 2 is positively guided into a storing section defined in the downstream side of the well 4. In this case, since the tail section 5B is provided at the trailing end of the airfoil-shaped forward section 5A, the floating material positively guided by the rotating impeller 7 is properly guided into the storing section of the well 4 and prevented from being pushed deeper into the water to escape from the well 4. It should be noted, however, that although the present invention is advantageously applicable to such a working catamaran for collecting solid and liquid floating materials on the water surface, the present invention should not be limited only to such applications, and the present invention is also applicable to any other types of catamarans, such as those intended to be used for pleasures, and to a working catamaran for collecting oil spills as disclosed in the above-identified United States Patent.

Figure 2:
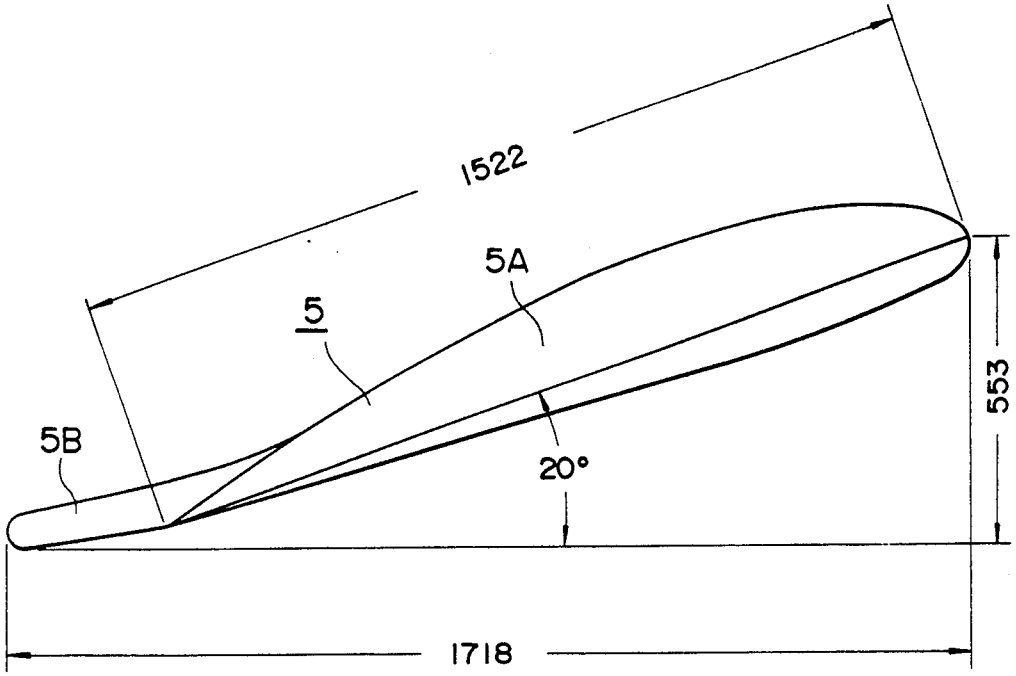
FIG. 2 is a schematic illustration showing on an enlarged scale the airfoil shaped connecting member provided in the catamaran shown in FIGS. 1*a* through 1*c;*

Referring now to FIG. 2, the structure of the airfoil-shaped connecting member 5 provided in the catamaran 1 shown in FIGS. 1*a* through 1*c* will be described in detail. As shown in FIG. 2, the connecting member 5 constructed in accordance with one embodiment of the present invention generally has a two-part structure, i.e., a forward section 5A and a rearward or tail section 5B. The forward section 5A is so designed to have an airfoil-shaped cross section and the tail section 5B may be any shape, such as a plate having generally parallel top and bottom surfaces as shown in FIG. 2.

The airfoil-shaped forward section 5A in the illustrated embodiment is defined by a pair of top and bottom curved surfaces, both of which are smooth curved surfaces and which are both generally convex with respect to its base line defined by a straight line connecting the leading and trailing edges of the airfoil-shaped forward section 5A. In the illustrated specific embodiment, the base line has a length of 1,522 mm. Also of importance, the airfoil-shaped forward section 5A is so arranged with its base line inclined forwardly to define a predetermined attack angle, which may range between 15° and 25°, most preferably approximately at 20°. Although the airfoil-shaped connecting member 5 of this embodiment has a smooth and convex curved surface for both of its top and bottom surfaces, the connecting member 5 may have any other shapes without departing from the spirit and scope of the present invention as long as such other shapes can provide a proper lift to the catamaran 1 so as to prevent the bow from being submerged when cruising at a relatively high speed. For example, the bottom surface of the airfoil-shaped forward section 5A may be convex with respect to its base line at least partly.

As described before, the forward section 5A has a main function of providing a lift to the bow of the catamaran 1 when cruising at a relatively high speed, and the tail section 5B has a main function of guiding the flow of water after passing the airfoil-shaped forward section 5A. Thus, without departing from the spirit and scope of the present invention, the tail section 5B may be omitted if there is no need to provide such a guide for the flow of water in the downstream of the airfoil-shaped forward section 5A. For example, when the present invention were applied to a working catamaran for collecting floating materials, such as debris or oil, on the water surface, then the provision of such a tail section 5B would be required because of its function. However, if the present invention were to be applied to a catamaran for other purposes, such as sightseeing, transportation or the like, then the provision of such a tail section 5B would not be necessary.

Figure 3:
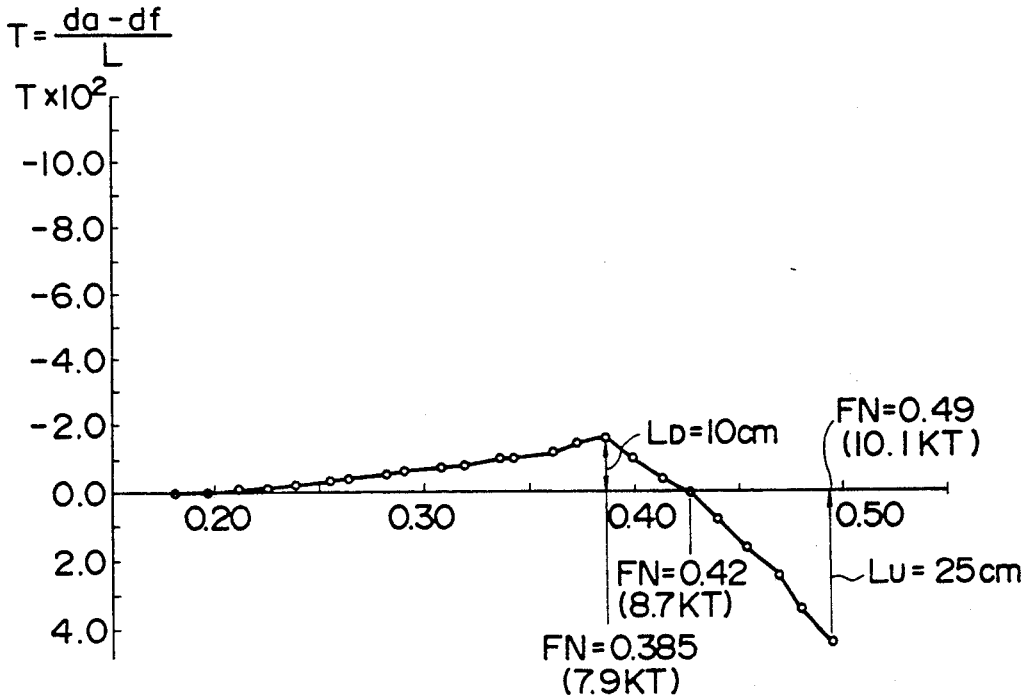
FIG. 3 is a graph showing the cruising performance of the catamaran shown in FIGS. 1*a* through 1*c*.
Figure 4A:
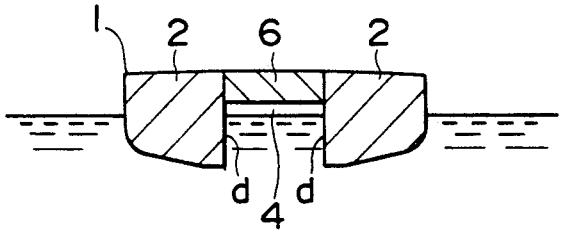
Fig. 4a Prior Art
FIGS. 4*a* through 4*c* are schematic illustrations showing a prior art working catamaran suitable for use in collecting floating materials on the water surface.
Figure 4B:
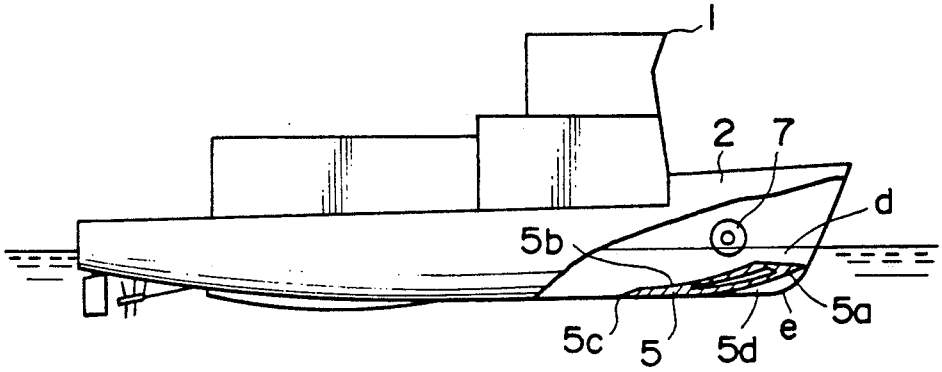
Fig. 4b Prior Art
Figure 4C:
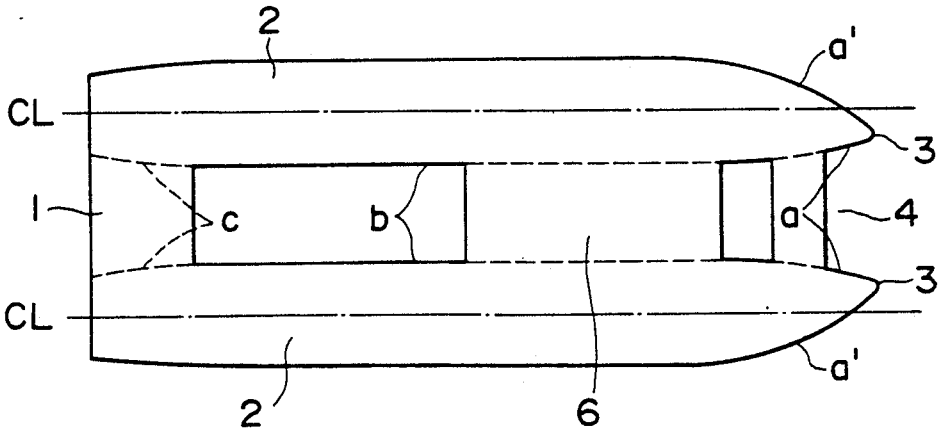
Fig. 4c Prior Art

FIG. 3 shows a lift characteristic of the airfoil-shaped connecting member 5. In FIG. 3, the ordinate T is an indication of a height of the bow, where $T=(da-df)/L$, and the abscissa FN is the Froude Number which is an indication of the cruising speed, where $FN=V/SQRT(L\times g)$. Here, da=forward draft, df=aft draft, L=effective length of the catamaran, V=cruising speed, $g=9.8$ m/sec$^2$, and KT=knot. In the specific embodiment shown in FIG. 3, L=11.5 meters. As shown in FIG. 3, when the cruising speed was 7.9 KT, $T=L_D$ (=−10 cm) where $L_D$ is non-dimensional depth for the water surface, so that the bow was pulled into the water by 10 cm as compared with the case when the catamaran 1 is not cruising or cruising at a very slow speed. On the other hand, as shown in FIG. 3, when the cruising speed of catamaran 1 increased beyond 7.9 KT, the bow started to received a lift so that the bow started to pushed upward relative to the water surface. And, at the cruising speed of FN=0.49 (10.1 KT), $T=L_U$ (25 cm) where $L_U$ is non-dimensional height from the water surface, so that the bow was raised in height relative to the water surface as compared with the case when the catamaran 1 was not cruising or cruising at a relatively low speed.

As indicated in FIG. 3 and described above, the catamaran 1 starts to receive enough lift to keep its bow properly above the water surface once it exceeds a critical speed so that the present catamaran 1 can cruise stably at a relatively high speed. In addition, the bow is not pulled downward excessively at low and intermediate speeds, at which a collection operation is carried out most effectively, so that the present catamaran 1 is stable at any cruising speed.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. A water vessel having a bow and a stern, comprising:

a pair of floats spaced apart from each other over a predetermined distance and arranged in parallel;

first connecting means for connecting said pair of floats, said first connecting means extending between said pair of floats in the air when said vessel is afloat on a horizontal water surface; and second connecting means for connecting said pair of floats, said second connecting means extending between said pair of floats and fixedly attached thereto at a location to be submerged in the water when said vessel in afloat, said second connecting means including an airfoil-shaped section for providing a lift to the bow of said vessel when cruising and a substantially flat tail section which extends continuously in a downstream direction from a downstream end portion of said airfoil-shaped section for guiding a flow of the water after the flow of water has past over said airfoil-shaped section in a predetermined direction, said airfoil-shaped section consisting essentially of a smooth top convexly curved surface extending from an upstream end of said airfoil-shaped section to a hypothetical downstream end thereof and a bottom convexly curved surface extending from said upstream end to said downstream end, whereby a base line is defined as a hypothetical straight line drawn between said upstream and downstream ends of the airfoil-shaped section, said top and bottom curved surfaces being asymmetrical with respect to said base line, said airfoil-shaped section being inclined such that an attack angle defined between the horizontal water surface and said base line is in a range between 15° and 25°;

wherein said second connecting means tail section extends continuously from a trailing edge of said airfoil-shaped section in a predetermined downstream direction; and further comprising rotating means disposed above said second connecting means and partly submerged in the water at its bottom portion for positively guiding any material floating on the water surface into a downstream section of a space defined between the pair of floats

2. The vessel of claim 1, wherein said attack angle is set approximately at 10°.

3. The vessel of claim 1, wherein said tail section is comprised of a plate having generally parallel top and bottom surfaces.

4. The vessel of claim 1, wherein each of said pair of floats has an inner side surface which is opposite to a corresponding inner side surface of the other float and which is substantially vertical.

5. The vessel of claim 1, wherein said rotating means includes an impeller which may be rotated to cause a positive flow of water into the space between the pair of floats from a bow end of said vessel and wherein said flow of water is guided into said space by said tail section.

6. The vessel of claim 1, wherein each of said pair of floats is elongated in shape and has a bow end which is located at a side closer to the other float with respect to a longitudinal center line thereof.

* * * * *